United States Patent [19]

Anderka et al.

[11] 4,221,496

[45] Sep. 9, 1980

[54] WRITING FLUID CARTRIDGE

[75] Inventors: Gerold Anderka, Ellerbek; Hans-Joachim Ritter; Werner Zuchner, both of Hamburg, all of Fed. Rep. of Germany

[73] Assignee: Mesne Koh-I-Noor Rapidograph, Inc., Bloomsbury, N.J.

[21] Appl. No.: 963,622

[22] Filed: Nov. 24, 1978

[30] Foreign Application Priority Data

Nov. 23, 1977 [DE] Fed. Rep. of Germany ..... 2752264

[51] Int. Cl.[3] ..... B43K 5/10

[52] U.S. Cl. ..... 401/258; 401/45

[58] Field of Search ..... 401/45, 44, 132–135, 401/140, 151, 258, 259, 260, 222, 223, 230, 236, 237

[56] References Cited

U.S. PATENT DOCUMENTS

| | | | |
|---|---|---|---|
| 1,265,325 | 5/1918 | Greenfield | 401/45 |
| 1,797,465 | 3/1931 | De Biasi | 401/45 |
| 2,130,978 | 9/1938 | White | 401/45 |
| 2,902,978 | 9/1959 | Legnani | 401/44 X |
| 2,961,999 | 11/1960 | Torchi | 401/45 |
| 3,167,057 | 1/1965 | Bross | 401/133 |
| 3,788,754 | 1/1974 | Glasa | 401/259 X |
| 3,905,709 | 9/1975 | Bok | 401/258 X |

*Primary Examiner*—Edward M. Coven

*Attorney, Agent, or Firm*—David H. Semmes

[57] ABSTRACT

The invention refers to an improved writing fluid cartridge or writing fluid tank with a connection section at the front end for attachment to a writer, especially a tube writer, wherein the cartridge is divided into at least two sealably separate compartments, one of which having an ink capacity equal to substantially the ink capacity of the writer body.

10 Claims, 11 Drawing Figures

WRITING FLUID CARTRIDGE

BACKGROUND OF THE INVENTION

Writing fluid cartridges or writing fluid tanks are widely used to hold ink for tube writers. In use, as writing fluid is used up from the cartridge chamber, the fluid is replaced by air; for example, by air which enters from the ink equalization chamber present in tube writers.

While the writing fluid volume in the cartridge or tank changes only relatively little as the temperature changes, the same temperature changes cause essentially greater volume changes to any air present in the writing fluid holding chamber. Upon warming this air expands, causing a raised pressure, which pushes writing fluid into the body of the writer which must be taken up by the equalization chamber, in order to avoid a drip or blot. The equalization chamber must be so constructed as to be able to take up all writing fluid that is forced out, even in the unfortunate event that a great portion of the original writing fluid volume has already been replaced by air in the holding chamber of the cartridge or tank, without causing writing fluid to run out of the equalization chamber.

As soon as a writing fluid cartridge or tank is attached to a tube writer that has been thoroughly cleaned, a relatively large amount of writing fluid immediately runs out of the cartridge, or fill a corresponding volume within the body of the writer, so as to create a writing fluid connection between the cartridge and the tube writer, or the like. Consequently, a relatively large empty space is initially created in the cartridge, and immediately after the ink cartridge has been so attached. This space fills with air, by means of the equalication chamber, thus balancing the pressures. Even in the most ideal working conditions, temperature changes cause considerable changes in this air volume, which becomes even greater as more writing fluid is used from the cartridge.

BRIEF SUMMARY OF THE INVENTION

The object of the invention is to provide a writing fluid cartridge or tank which will considerably lessen the air volume expansion effects which arise from temperature changes.

The solution to the problem is a writing fluid cartridge or tank as described above so constructed that the writing fluid chamber is divided into at least two smaller compartments, or sub-chambers, which are either sealed off from one another or are capable of being sealed off from one another. One of the compartments will have an ink capacity substantially equal to that of the body of the writer.

With such a cartridge, it is possible to initially connect only that sub-chamber whose volume is equal to that of the body of the writer, so that the writing fluid in that sub-chamber can flow into the body of the writer and fill it completely to the tip. After that, the other sub-chamber is connected to the body of the writer. This second sub-chamber is either already sealed off from the empty sub-chamber or can now be sealed off so that the air collecting in the first sub-chamber (as a result of the filling of the writer body) no longer exerts any influence upon the writer. At the same time, the suub-chamber now connected with the writer body is practically full of writing fluid, i.e., it contains no appreciable air volume at the start of writing which would lead to the above-discussed unfavorable effects, due to ambient temperature changes.

Further features and advantages of the present invention will become more evident from the following description of preferred embodiments, wherein reference is made to the accompanying drawings, which are schematic representations of an invention which is defined by the appended claims.

DESCRIPTION OF THE PREFERRED EMBODIMENTS

Figure 1:
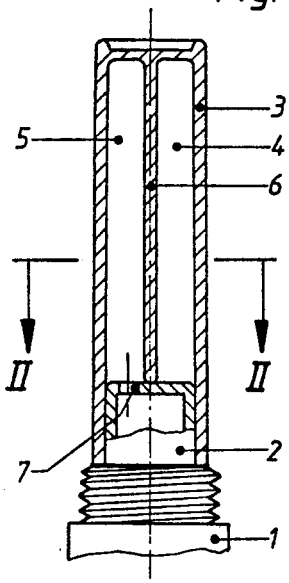
FIG. 1 shows a first embodiment, with an ink tank in cross-section with a dividing wall extending axially. The tank is shown as it attaches to the attachment section of a conventional writer body, only partially shown.
Figure 2:
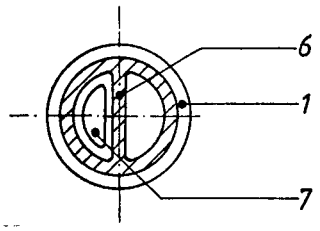
FIG. 2 shows a cut-away along Line II—II in FIG. 1.

The ink tank embodiment shown in FIGS. 1 and 2 has an outer wall 3 and a dividing wall 6 running axially so as to form two adjacent compartments, or sub-chambers, 4 and 5 which contain ink. At least one of these sub-chambers has an ink capacity substantially equal to the ink volume space within the partially depicted, and conventional writer body, 1.

The writer body 1 includes a conventional rear extension, 2, for a frictional attachment of an ink cartridge. The forward section of the outer wall of an ink cartridge makes contact with the outer cylinder surface of this extension 2, thus forming a seal. When an ink tank according to this embodiment of the present invention is attached, the forward end of the dividing wall 6 also forms a seal with the back surface of this conventional writer body extension 2.

In FIG. 1, the extension 2 is provided with a flow channel 7 that is situated off center from the longitudinal axis of the writer body 1 and the attached ink tank, and as is shown in FIG. 2, this channel is specially shaped as a semi-circle. With the ink tank in the position illustrated in FIG. 1, the sub-chamber 5 is connected to the flow channel 7 and sub-chamber 4 is totally sealed off from the flow channel. If a full ink tank is connected to the extension 2 of a previously totally cleaned writer body, sub-chamber 5 will fill the writer body with ink. Since the volume of sub-chamber 5 substantially equals the ink holding volume within writer body, 1, sub-chamber 5 is nearly totally emptied and the writer body 1 is made ready for use.

After sub-chamber 5 is emptied, the ink tank of FIG. 1 is turned around the longitudinal axis of the writer body (which is also the longitudinal axis of the ink tank) so that sub-chamber 4 then connects with the flow channel 7 and the first sub-chamber 5 is now totally sealed off from the flow channel. Since the body of the writer is full of ink, no ink flows immediately from sub-chamber 4 into the writer body. Thus, no relatively large volume of air accumulates in sub-chamber 4 which could strongly influence the sub-chamber's ink discharge when ambient temperature changes occur.

Figure 3:
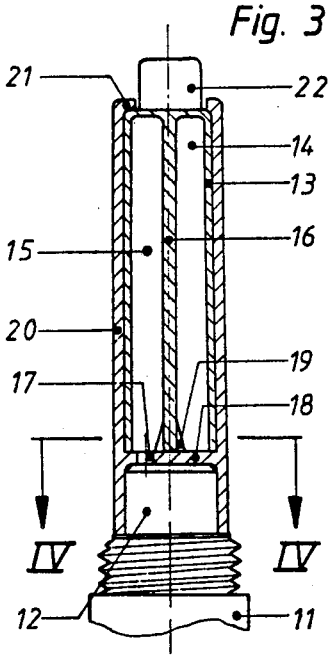
FIG. 3 shows a cut-away through a second embodiment of an ink tank, also with an axially extending dividing wall.
Figure 4:
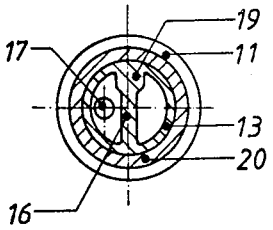
FIG. 4 shows a cut-away along Line IV—IV in FIG. 3.

While a writer body with a specially situated flow channel opening may be necessary to use the first ink tank embodiment of FIGS. 1 and 2, the ink tank illustrated in FIGS. 3 and 4 is suited for use with more conventional writer bodies, 11. The second ink tank embodiment comprises two parts. An outer part exhibits an outer wall 20, a cross wall 18, and a ring ridge 21, at the back end of the outer part. An inner part has an outer wall 13, an inner chamber consisting of two sub-chambers 14, 15 formed by a dividing wall 16, and a grip element 22 at the back end of the inner part. The inner part is located inside the outer part and is located so that the front end of its outer wall 13 and the front end of its dividing wall 16 forms a seal against the cross wall 18 of the outer part. The ring ridge 21 on the outer part engages and bears upon the inner part such that this seal remains constant. The extending section of the surrounding wall 20 of the outer part can therefore be attached relatively fixedly to a connector extension 12 as is found on a totally conventional tube writer 11, not further illustrated.

As illustrated in FIG. 3, there is a circular flow channel 17 within the cross wall 18, situated off center from the longitudinal axis of the writer body 11 and ink tank. The flow channel 17 can be connected with either sub-chamber 14 or 15 thus connecting it with the writer body after the fashion illustrated in FIGS. 1 and 2. At the same time the other sub-chamber is sealed off from the flow channel. Turning of the inner part in relation to the outer part, which is clamped to extension 12 of writer body 11, is done by means of the grip part 22 (firmly attached to the inner part) which extends to the rear beyond the ring ridge 21.

As illustrated in FIGS. 3 and 4, dividing wall 19 is flared, at its lower end, in the direction of outer wall 13. This flare has a radial extension which corresponds with the radial position of the circular flow channel 16, through cross wall 18. The under surface of flare 19 is larger than the diameter of the flow channel 17. Thus, the flow channel 17 can be sealed off by the flare 19 by turning the inner part in relation to the outer part. This seals off both sub-chambers from the writer body. This is helpful, for example, when one does not want to communicate any ink within the tank to the writer body immediately after attaching the cartridge, but wants to store the writing pen instead.

While FIGS. 1 through 4 show two embodiments in which the sub-chambers are arranged next to one another, FIGS. 5 through 11 show three further embodiments in which the sub-chambers lie axially one behind the other. In each of these additional three embodiments the hindmost sub-chamber is so designed that its volumetric ink capacity corresponds virtually identically to that of an empty writer body.

Figure 5:
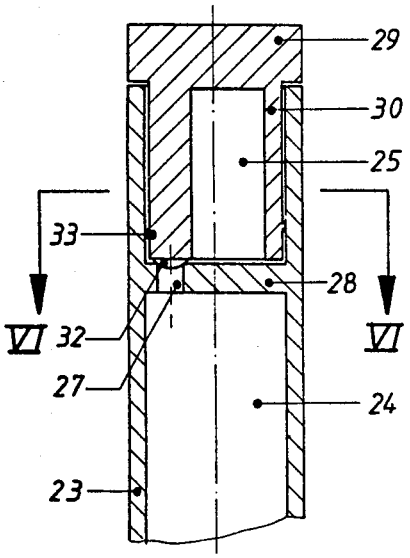
FIG. 5 shows a partial cut-away through a third embodiment, with an ink tank or cartridge having sub-chambers lying axially, one behind the other.
Figure 6:
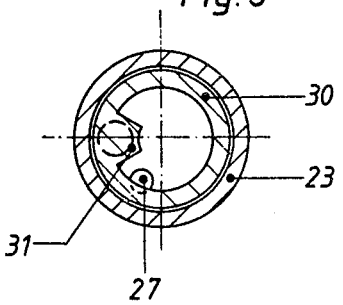
FIG. 6 shows a cut-away along Line VI—VI in FIG. 5.
Figure 7:
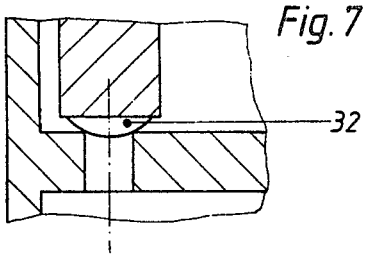
FIG. 7 shows an enlarged partial cut-away of FIG. 5.

The ink tank, with outer wall 23 shown in the third embodiment of FIGS. 5 through 7, is divided into two sub-chambers 24, 25, that lie axially, one behind the other, and separated by a cross wall, 28. The hindmost sub-chamber 25 is closed by a cap 29 which is operable to rotate around the longitudinal axis of the ink tank. This cap has a tube-shaped wall portion, 30, which extends into sub-chamber 25 to make contact, by means of a ring ridge, 33, upon the inner wall of sub-chamber 25 and also extends to contact cross wall 28.

As shown in FIG. 6, there is a flow channel opening 27 located off center on the cross wall and the tube-shaped wall 30 is extended to form a seal 31, with a lower seal protrusion, 32, that is shown in FIGS. 5 and 7, forming a seal with the flow channel opening 27.

When this third ink tank embodiment is attached to a writer body (not illustrated), the flow channel opening 27 is opened as is shown in FIG. 6 so that in filling the writer body an appropriate amount of ink flows from sub-chamber 25 into sub-chamber 24. When the writer body is full of ink, nearly all the ink in sub-chamber 25 has flowed into 24. Now the seal 31 is closed by rotating the cap 29 as shown in FIGS. 5 and 7, so that the air in sub-chamber 25 cannot escape into sub-chamber 24, which is full of ink.

Figure 8:
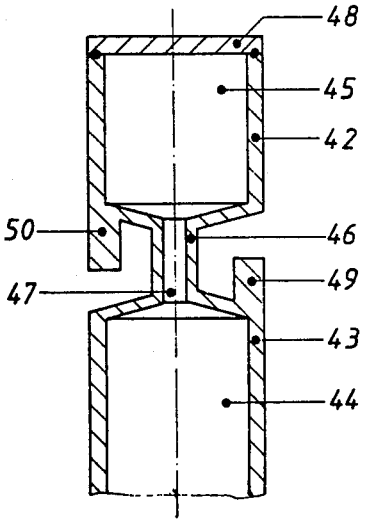
FIG. 8 shows a cut-away through a fourth embodiment, also with an ink cartridge or tank having sub-chambers lying axially, one behind the other.
Figure 9:
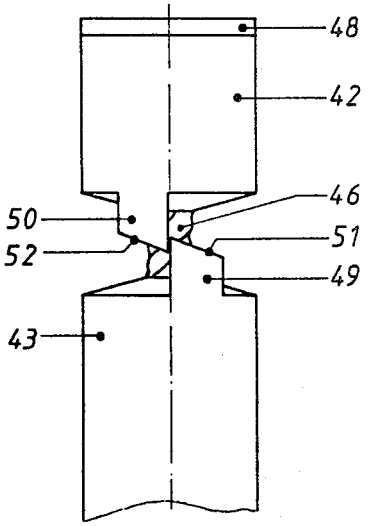
FIG. 9 shows a view of the ink cartridge or tank in FIG. 8 with illustration of the sealing stopper between the sub-chambers.

In the fourth embodiment of FIGS. 8 and 9, the sub-chambers 44 and 45 (which are themselves respectively defined by the outer walls 43 and 42) are connected by a narrow section 46 which has a connecting channel 47 of relatively small diameter and which exhibits a polygonal cross section. Sub-chamber 45 is sealed at its back end by means of a plate 48. On opposite sides, the walls 43, 42 are respectively lengthened to form stops 49 and 50, which extend vertically (in relation to the longitudinal axis of the ink tank) into the area in the middle of the restricted section 46. The free ends of these stops 51. 52 are preferably wedge-shaped, as is shown in FIG. 9.

According to this fourth embodiment, when the ink tank is attached to a conventional writer body (not illustrated), enough ink flows from sub-chamber 44 to fill the writer body. The ink which flows from sub-chamber 44 is replaced by ink simultaneously flowing from sub-chamber 45, so that practically no ink is left in sub-chamber 45.

Now the outer wall 42 with plate 48 is turned clockwise (seen from above in FIGS. 8 and 9) in relation to the outer wall 43 so that a torsional deformation of the restricted section 46 takes place. This closes flow channel 47. This turning motion brings stops 49 and 50 into contact with one another, and their wedge-shaped surfaces 51 and 52 slide over each other until stop 50 is "behind" stop 49. As shown in FIG. 9, this contact maintains the final positioning, and sub-chamber 45 is maintained sealed off from sub-chamber 44.

It should be mentioned that all ink cartridges and tanks covered in this invention are normally made of plastic, and with respect to the embodiment of FIGS. 8 and 9, of course, a type of semi-rigid plastic must be used (at least for the restricted section 46) that will allow the necessary distortion and plastic deformation without cracking or breaking.

Figure 10:
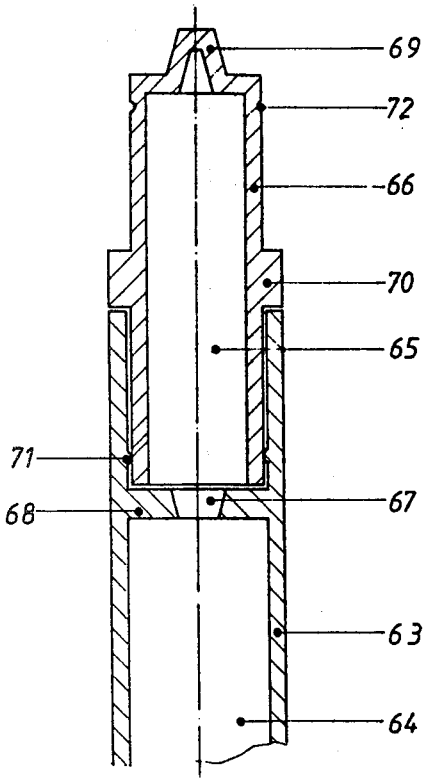
FIG. 10 shows a partial cut-away of a fifth embodiment, also with an ink cartridge or tank having sub-chambers lying axially one behind the other.
Figure 11:
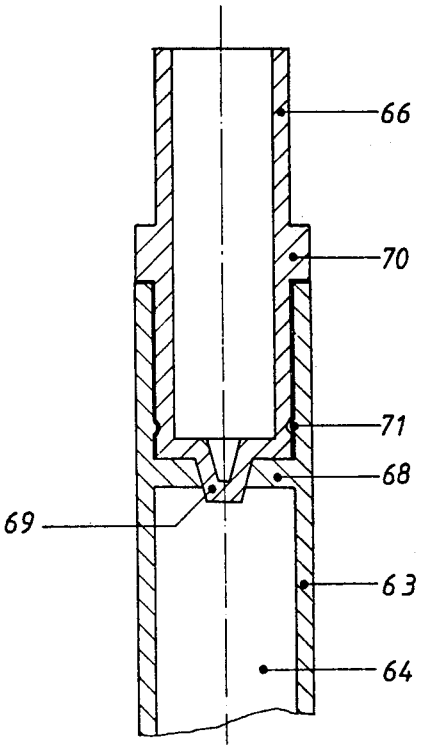
FIG. 11 shows a cut-away corresponding to FIG. 10 and illustrating the seal position between the two sub-chambers of the ink cartridge of the fifth embodiment.

The sub-chambers 64 and 65 of the fifth embodiment shown in FIGS. 10 and 11 are separated by a cross wall, 68, which includes a truncated cone-shaped central opening, 67, having its narrow end downward, towards compartment 64. This cross wall 68 is formed integrally with the outer wall 63. As shown in FIG. 10, a tubular element 66 sticks inside an upper, open end of the cylindrical chamber formed by outer wall 63, with the inside end of wall 66 open, and its back end closed and shaped into a truncated cone-shaped sealing protrusion, 69, extending upwardly. To seal sub-chamber 65 within outer wall 63, a ring ridge 71 is provided on the inner surface of outer wall 63, close to the cross wall 68. This first ring ridge 71 makes a seal with the outer surface of the tubular element 66. A second ring ridge 70 is directed outwardly and around the middle of tubular element 66, and serves to position this tubular element into either of the positions illustrated in FIGS. 10 and 11.

When the bottom of the sub-chamber 64, in the position of FIG. 10, is placed downwardly upon a writer point (not illustrated), as has already been described in connection with the embodiments according to FIGS. 5 through 9, enough ink ruuns into the writer body to drain the rear sub-chamber, 65. Now, tube element 66 is removed from its position shown in FIG. 10, turned over, and reinserted with sealing protrusion 69 to the front. This seals off opening 67 and forms an additional seal between the ring ridge 71 and a ring groove 72 in the outer surface of the tube element 66.

While preferred embodiments of our invention have been described, as required by 35 U.S.C. 112, first paragraph, our invention is to be defined by the scope of the appended claims.

We claim:

1. In a writing fluid cartridge of the type having a connection section on its front end which is operable to be attached to a tubular writing pen, or the like, the improvement comprising a writing fluid compartment which is divided into at least two smaller sub-chambers, said cartridge further comprising means to enable each of said sub-chambers to be sealed off one from the other, wherein further one of said sub-chambers has a volumetric capacity which is substantially equal to the ink capacity of the writing pen to which it is operable to be attached, whereby one sub-chamber is operable to be initially put into a flow communication with said writing pen to completely fill said pen with writing fluid, thereupon said one sub-chamber is operable to be sealed off from said writing pen, and only a second sub-chamber then communicated to said writing pen to further supply writing fluid thereto, without air remaining within said one sub-chamber exerting any influence on said pen.

2. A writing fluid cartridge according to claim 1 characterized in that said one sub-chamber (25, 45, 65) having a volume substantially equal to the volume of writing fluid that can be taken into the writer lies axially behind a second sub-chamber (24, 44, 64), and said sealing means is a sealing mechanism comprising portions of each sub-chamber which can be engaged if desired to provide a seal between the sub-chambers.

3. A writing fluid cartridge according to claim 2 characterized in that said sealing mechanism further comprises a cross wall (28) that is located between the sub-chambers (24, 25) and includes an opening (27) that is eccentric relative to the longitudinal axis of said cartridge wherein further a cap (29), which is rotatable around said longitudinal axis, extends into the rear chamber (25) and further includes a sealing pin (31, 32) which extends to a cross wall (28) defined by said second sub-chamber, wherein further the pin diameter (31, 32) is greater than that of the opening (27) in said cross wall and between said sub-chambers, said pin (31, 32) being situated the same distance from said longitudinal axis as said opening (27).

4. A writing fluid cartridge according to claim 2 characterized in that said sealing mechanism further comprises a cross wall (68), with a central opening (67), which is located between the chambers (64, 65), wherein a tube element (66) that is open on a front end and closed on a second end is operable to be removably inserted to comprise said rear sub-chamber, and said tube element (66) comprises at its closed end a sealing protrusion (69) that is directed outwardly from said second end and also is located centrally and is cone-shaped.

5. A writing fluid cartridge according to claim 2 characterized in that there is provided a restricted section (46) located between the two chambers (44, 45) which can be brought into sealing position by rotating the first sub-chamber around said longitudinal axis, wherein stops (49, 50) extend from the container walls (42, 43) of both chambers into an open area surrounding said restricted section (46), the axial length of each of these stops (49, 50) being greater than half the axial length of the restricted section (46) and the free ends of said stops being adapted to form interfacing wedges (51, 52) which engage one with the other upon said rotating.

6. A writing fluid cartridge operable for connection to a tubular writing pen, or the like, wherein a dividing wall is provided to run axially within said cartridge to thereby define at least two sub-chambers (4, 5, 14, 15); said sub-chambers being open at their front ends and said cartridge further comprising said dividing wall (6, 16) and rotation means operable to allow a first sub-chamber to be brought initially into an alignment and flow communication with a flow channel (7, 17) that communicates with the inside of the writing pen, wherein further said flow channel is situated eccentric with respect to the longitudinal axis of the cartridge and the writing pen, whereby said first sub-chamber has a volume substantially equal to the volume within said writing pen and may be brought into said alignment with said flow channel by rotating said dividing wall around said longitudinal axis, to initially fill said writing pen with writing fluid, thereafter a further rotation of said dividing wall is operable to define a flow communication only between said flow channel and a second sub-chamber.

7. A writing fluid cartridge according to claim 6 adapted for use with a tubular writing pen, or the like, which comprises a connection section formed by an outer wall (3) which extends axially beyond the front end of the dividing wall (6) wherein further the front end of the dividing wall (6) is adapted to engage a surface on said writing pen and define a seal between said sub-chambers when the cartridge is inserted upon the writing pen.

8. A writing fluid cartridge according to claim 6 characterized by two parts which rotate relative to each other around the longitudinal axis, wherein the innermost of the two parts comprises two sub-chambers (14, 15), opening to their front ends and dividing wall (16), and theh outermost part comprises a connection section together with a flow channel (17) that is located within a cross wall (18), wherein the front end of said inner part together with the front end of said dividing wall (16) are in engagement with said cross wall and form a seal.

9. A writing fluid cartridge according to claim 8 characterized in that said outer part further comprises a ring ridge (21) which makes contact with the rear end of said inner part, wherein further said rotation means comprises a grip part (22) which is firmly attached to the inner part and extends rearwardly beyond the end of the outer part.

10. A writing fluid cartridge or tank according to either of claims 6, 7, 8, or 9 characterized in that an expanded area (19) is provided on the front end of said dividing wall (16), wherein the radial position of this expanded area (19) is rotatable to correspond to the radial position of said flow channel (17) and the forward cross sectional surface of said expanded area is larger than the cross sectional surface of said flow channel (17), and thereby able to seal said flow channel from a flow communication to either sub-chamber.

* * * * *